US011448034B2

(12) United States Patent
Turner et al.

(10) Patent No.: US 11,448,034 B2
(45) Date of Patent: Sep. 20, 2022

(54) REMOVABLE PLUGGING METHOD AND APPARATUS

(71) Applicant: Saudi Arabian Oil Company, Dhahran (SA)

(72) Inventors: Robert John Turner, Dhahran (SA); Brett Bouldin, Spring, TX (US)

(73) Assignee: Saudi Arabian Oil Company, Dhahran (SA)

( * ) Notice: Subject to any disclaimer, the term of this patent is extended or adjusted under 35 U.S.C. 154(b) by 107 days.

(21) Appl. No.: 16/926,964

(22) Filed: Jul. 13, 2020

(65) Prior Publication Data

US 2022/0010649 A1 Jan. 13, 2022

(51) Int. Cl.

| | |
|---|---|
| ***E21B 33/12*** | (2006.01) |
| ***E21B 29/02*** | (2006.01) |
| ***E21B 36/00*** | (2006.01) |

(52) U.S. Cl.

CPC ..... *E21B 33/1212* (2013.01); *E21B 29/02* (2013.01); *E21B 36/008* (2013.01)

(58) Field of Classification Search

CPC ..... E21B 29/02; E21B 33/1212

See application file for complete search history.

(56) References Cited

U.S. PATENT DOCUMENTS

| | | | |
|---|---|---|---|
| 5,188,182 | A | 2/1993 | Echols, III et al. |
| 5,607,017 | A | 3/1997 | Owens et al. |
| 6,026,903 | A | 2/2000 | Shy et al. |
| 6,334,488 | B1 | 1/2002 | Freiheit |
| 7,290,609 | B2 | 11/2007 | Wardlaw et al. |
| 10,053,951 | B2 | 8/2018 | Carragher et al. |
| 10,072,477 | B2 | 9/2018 | Cooper et al. |
| 10,590,736 | B2 | 3/2020 | Madell et al. |
| 2013/0087335 | A1 | 4/2013 | Carragher et al. |
| 2014/0338923 | A1 | 11/2014 | Fripp et al. |
| 2015/0285026 | A1 | 10/2015 | Frazier |
| 2015/0345248 | A1 | 12/2015 | Carragher |
| 2016/0319633 | A1 | 11/2016 | Cooper et al. |
| 2017/0226819 | A1 | 10/2017 | Carragher |

FOREIGN PATENT DOCUMENTS

| | | | | |
|---|---|---|---|---|
| GB | 2417266 A | * | 2/2006 | ..... E21B 29/10 |
| GB | 2551693 A | | 1/2018 | |
| WO | 2016065244 A1 | | 4/2016 | |

OTHER PUBLICATIONS

"TCO Tubing Disappearing Plug—Non Explosive." TCOGroup, May 9, 2018, www.tcogroup.com/tdp-nonex/category115.html. 3 pages.

Extended European Search Report in corresponding EP Application No. 21185306.4, dated Nov. 11, 2021.

* cited by examiner

*Primary Examiner* — Robert E Fuller

(74) *Attorney, Agent, or Firm* — Leason Ellis LLP

(57) ABSTRACT

A method and apparatus for removably plugging a wellbore. The wellbore leads to a reservoir having a reservoir temperature. The method includes: selecting a melting point of a metal alloy based on the reservoir temperature; sealing the metal alloy against an interior wall of a tubing, while the tubing is above a ground in which the wellbore is drilled, such that the metal alloy defines a fluid barrier plug against flow of any portion of the reservoir through the tubing when the tubing is disposed within the wellbore; and heating the metal alloy above the melting point while the tubing is disposed within the wellbore such that the metal alloy flows from the tubing and the fluid barrier plug is eliminated.

22 Claims, 6 Drawing Sheets

REMOVABLE PLUGGING METHOD AND APPARATUS

FIELD OF THE DISCLOSURE

The present disclosure relates generally to removable plugging, and, more particularly, to a method and apparatus for removable plugging in a wellbore.

BACKGROUND OF THE DISCLOSURE

Tubing plugs are used in the majority of subterranean well completions that are in operation today. A tubing plug can take the form of a completion item and can be run with the completion, or can be set through tubing (e.g., using slickline or an electric line) after the completion has landed. The tubing plug is used to act as a fluid flow barrier for completion operations, including tubing pressure tests and packer setting. The tubing plug must also be removable so that the well can produce. As removal is integral to a tubing plug's functionality, a tubing plug is often referred to as a "disappearing plug."

Over the years, many different types of tubing plugs have been developed, including ceramic discs, dissolvable materials protected by impermeable sheaths, slowly dissolving materials, mechanical devices, and glass plugs. These types of tubing plugs have many shortcomings. Ceramic discs rely on an O-ring seal and are fragile, such that they are vulnerable to leaking or being accidentally broken. Moreover, even if a ceramic disc performs as designed, low density ceramic pieces sometimes flow to the surface of a well once the ceramic disc is broken during removal. At the surface, such pieces present a technical problem of potentially plugging or damaging surface valves and instrumentation. Plugs formed from dissolvable materials protected by impermeable sheaths also have various disadvantages, including that they are not truly plugs because accidental puncture of the sheath will commence dissolution of the material and cause leaking.

Furthermore, although slowly dissolving materials are enjoying a degree of popularity in the industry, their dissolution rate is fluid-dependent, and consequently their performance under downhole conditions is often complicated and difficult to control as required for completion operations. During the time required for completion operations, the dissolving material must dissolve slowly or not at all so that it can be effectively used as a tubing plug. After completion operations, the dissolving material must fully dissolve so that debris is minimized during flowback. Still further, while mechanical devices, glass, and other materials can function well as plugs, their removal (e.g., by cutting or mechanical fracture) is high-risk, can result in debris being left in the well, and is expensive.

Various other types of clamps and plugs utilized in subterranean wells are manufactured downhole for use as casing plugs. These plugs are not tubing plugs, and their downhole manufacturing requires cumbersome operations after a completion has been landed, thereby increasing costs and operational risks.

SUMMARY OF THE DISCLOSURE

According to an embodiment consistent with the present disclosure, a method for removable plugging in a wellbore which leads to a reservoir having a reservoir temperature is provided. The method includes: selecting a melting point of a metal alloy based on the reservoir temperature; sealing the metal alloy against an interior wall of a tubing, while the tubing is above a ground in which the wellbore is drilled, such that the metal alloy defines a fluid barrier plug against flow of any portion of the reservoir through the tubing when the tubing is inserted into the wellbore; and heating the metal alloy above the melting point while the tubing is inserted into the wellbore such that the metal alloy flows from the tubing and the fluid barrier plug is eliminated.

In an embodiment, sealing the metal alloy against the interior wall of the tubing includes sealing the metal alloy between the interior wall of the tubing and an exterior wall of a sleeve disposed in the tubing, and heating the metal alloy above the melting point includes heating the metal alloy using a thermite element disposed within the sleeve.

In an embodiment, the method further includes using a firing head coupled to the thermite element to ignite the thermite element such that the thermite element heats the metal alloy above the melting point.

In an embodiment, the method further includes: positioning the sleeve on a temporary base within the tubing before sealing the metal alloy; and removing the temporary base after sealing the metal alloy, where sealing the metal alloy includes sealing the metal alloy between the exterior wall of the sleeve and the interior wall of the tubing such that the metal alloy holds the sleeve in place after the temporary base is removed.

In an embodiment, the method further includes removing the sleeve and the thermite element from the tubing as a unit after the fluid barrier plug is eliminated.

In an embodiment, the method further includes disposing the thermite element within the sleeve by moving at least one latch coupled to the thermite element into at least one corresponding notch of the sleeve, where removing the sleeve and the thermite element from the tubing as the unit includes using a cable coupled to the thermite element to remove the sleeve and the thermite element from the tubing while the at least one latch is positioned in the at least one corresponding notch.

In an embodiment, selecting the melting point includes selecting the melting point to be less than a threshold amount higher than the reservoir temperature, such that the heating of the metal alloy above the melting point causes the metal alloy to be eliminated from a cross-sectional area of the tubing without damaging the interior wall of the tubing.

In an embodiment, selecting the melting point includes selecting a ratio of bismuth (Bi) to tin (Sn) in the metal alloy.

According to another embodiment consistent with the present disclosure, an apparatus for removable plugging in a wellbore which leads to a reservoir having a reservoir temperature is provided. The apparatus includes: a tubing having an interior wall; a sleeve having an exterior wall; a metal alloy having a melting point selected in view of the reservoir temperature and being disposed in a space between the interior wall of the tubing and the exterior wall of the sleeve, where the metal alloy is in a solid state and occupies the space between the interior wall of the tubing and the exterior wall of the sleeve to thereby define a fluid barrier plug against flow of any portion of the reservoir through the tubing; and a thermite element configured to selectively provide heat to the metal alloy above the melting point when the tubing is inserted into the wellbore and thereby cause the metal alloy to flow from the space and eliminate the fluid barrier plug, where the sleeve and the thermite element are removable as a unit from the tubing when the fluid barrier plug is not present.

In an embodiment, the metal alloy is a eutectic alloy comprising constituents selected in view of one or more completion fluids to be used in completion operations of a subterranean well defined by the wellbore.

In an embodiment, the eutectic alloy is a bismuth (Bi) and tin (Sn) alloy.

In an embodiment, the melting point is selected to be less than a threshold amount higher than the reservoir temperature such that the heat provided to the metal alloy above the melting point causes the metal alloy to be eliminated from a cross-sectional area of the tubing without damaging the interior wall of the tubing or the exterior wall of the sleeve.

In an embodiment, the sleeve includes at least one notch, and the sleeve is configured to hold the thermite element when at least one corresponding latch coupled to the thermite element is moved into the at least one notch.

In an embodiment, the apparatus further includes a cable coupled to the thermite element, where the cable is usable to remove the sleeve and the thermite element from the tubing as the unit when the fluid barrier plug is not present.

In an embodiment, the apparatus further includes: a cable; and a firing head coupled to the thermite element and to the cable, where the firing head is configured to ignite the thermite element in response to a current flow through the cable to cause the thermite element to provide the heat to the metal alloy.

According to another embodiment consistent with the present disclosure, an apparatus for removable plugging in a wellbore which leads to a reservoir having a reservoir temperature is provided. The apparatus includes: a tubular item usable as part of a completion in a subterranean well defined by the wellbore, the tubular item having a first wall defining an interior of the tubular item; a second wall within the interior of the tubular item, the first wall and the second wall defining a fluid flow region within the interior of the tubular item; and a metal alloy having a melting point selected in view of the reservoir temperature and being disposed in a space in the fluid flow region between the first wall and the second wall before the tubular item is disposed in the wellbore as part of the completion, where the metal alloy is in a solid state and occupies the space in the fluid flow region between the first wall and the second wall to thereby define a fluid barrier plug against flow of any portion of the reservoir through the tubular item when the tubular item is disposed in the wellbore as part of the completion, and where the metal alloy is configured to flow from the space upon being heated above the melting point such that the fluid barrier plug is eliminated.

In an embodiment, the apparatus further includes a thermite element configured to selectively provide heat to the metal alloy above the melting point when the tubular item is disposed in the wellbore as part of the completion and thereby cause the metal alloy to flow from the space such that the fluid barrier plug is eliminated, where the second wall separates the thermite element from the metal alloy.

In an embodiment, the apparatus further includes: a cable; and a firing head coupled to the thermite element and to the cable, where the firing head is configured to ignite the thermite element in response to a current flow through the cable to cause the thermite element to provide the heat to the metal alloy.

In an embodiment, the metal alloy is a eutectic alloy.

In an embodiment, the eutectic alloy is a bismuth (Bi) and tin (Sn) alloy.

Any combination of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

Figure 1:
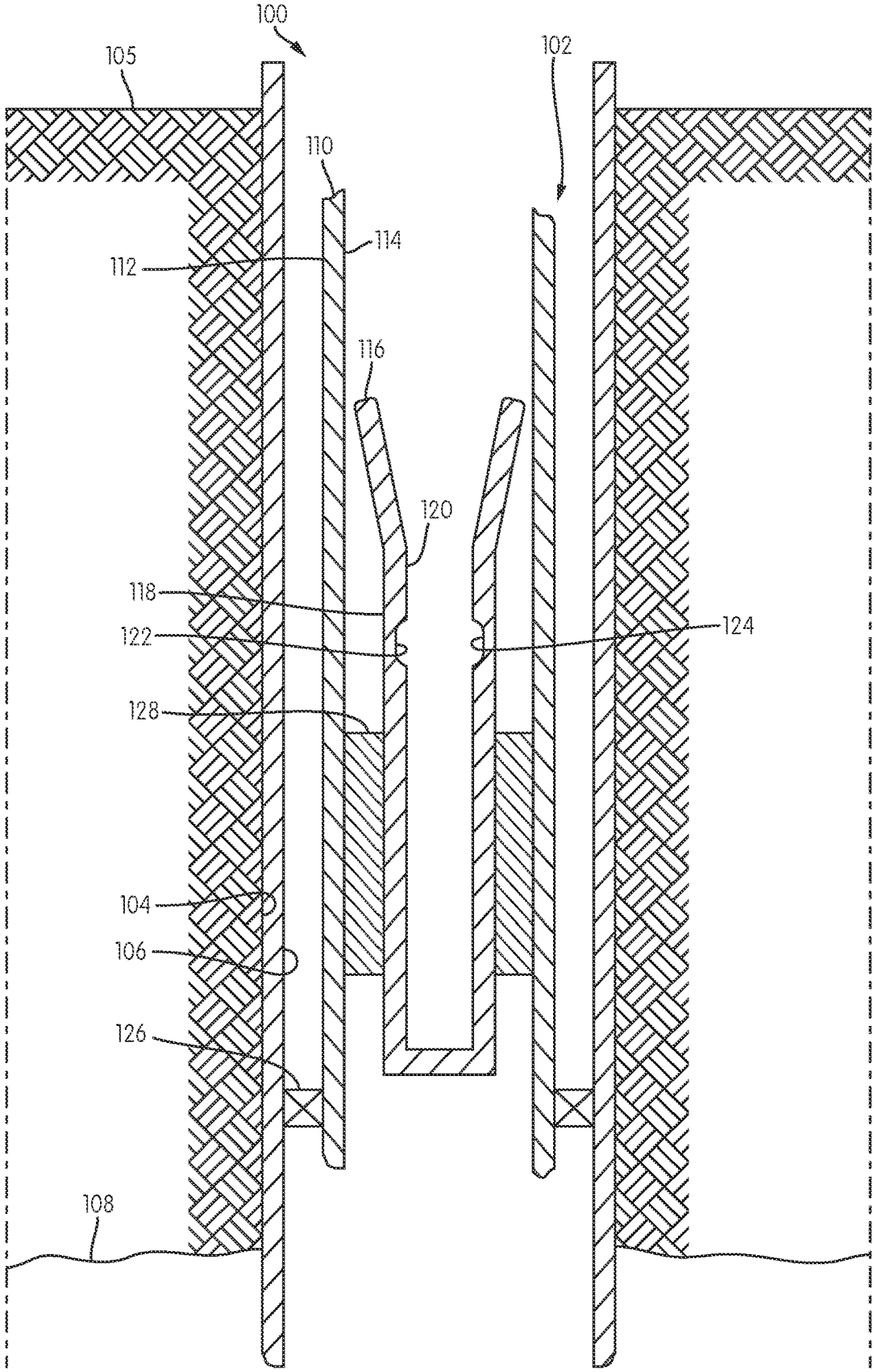
FIG. 1 is a diagrammatic cross-sectional view of an example well system that includes an example apparatus for removable plugging in a wellbore, according to an embodiment.

It is noted that the drawings are illustrative and are not necessarily to scale.

DETAILED DESCRIPTION OF CERTAIN EMBODIMENTS OF THE DISCLOSURE

Example embodiments consistent with the teachings included in the present disclosure are directed to a method and apparatus for removable plugging in a wellbore. Embodiments include a removable metal alloy plug that is formed in an item, such as a tubing, before the tubing is run as part of a completion of a subterranean well defined by the wellbore. The plug provides a fluid barrier usable during completion operations such as pressure tests and packer setting and is removable from the tubing when the tubing is disposed in the wellbore.

In various embodiments, the metal alloy has a melting point selected in view of a temperature of a reservoir to which the wellbore leads, and more particularly, so as to be higher than a maximum service temperature expected in the wellbore, so that when the metal alloy is heated above the melting point while the tubing is inserted into the wellbore, the metal alloy completely flows from a space in which the metal alloy had formed the plug. The plug is thus eliminated, and well operations proceed without the risks of debris, instrumentation damage, or improperly-timed plug dissolution that are presented in previously known plugs.

In many embodiments, the metal alloy comprises a eutectic alloy. In certain embodiments, the eutectic alloy has constituents selected in view of one or more completion fluids to be used in completion operations of the well, and/or in view of one or more fluids in the reservoir. For example, in some embodiments, the eutectic alloy is a bismuth (Bi) and tin (Sn) alloy. The bismuth and tin alloy provides high corrosion resistance against fluids such as brines and high strength acids that are present in some completion environments.

In some embodiments, the metal alloy forms the plug between an interior wall of the tubing and an exterior wall of a sleeve. The sleeve is disposed in the tubing and is configured to receive a heating element, such as a thermite element. The thermite element is configured to selectively provide heat to the metal alloy above the melting point when the tubing is inserted in the wellbore to cause the metal alloy to melt and flow from the space in which the metal alloy had formed the plug. The sleeve and the thermite element are removable from the tubing as a unit after the metal alloy melts and the plug is eliminated.

By providing a fluid barrier plug in an item to be run as part of a completion in a well, while the item is above ground and has not been run as part of the completion, the present techniques avoid the drawbacks and risks associated with downhole manufacturing of a plug. The present techniques instead allow the plug to be manufactured in a carefully controlled environment and be pressure-tested to a specification that ensures its adequacy for use in completion operations.

In some embodiments, as further described below, the metal alloy is melted so as to form a gas-tight metal-to-metal (MTM) seal when the molten metal alloy solidifies from outside to inside, with expansion of the metal alloy upon solidification locking in stress and providing a fluid barrier plug suitable for use in completion operations once the tubing is disposed in the well. This seal is formed in the controlled manufacturing environment to optimize the performance of the resulting plug, providing an advantage over downhole plug manufacturing techniques that are unable to replicate the conditions and precision of a controlled manufacturing environment. A fluid barrier plug defined by a metal alloy in a gas-tight MTM seal is also resistant to breaking if, for example, tools are accidentally dropped into the wellbore 104 when running the completion in the well system 100. Additionally, forming the plug using a eutectic alloy allows the plug to be structurally sound during completion operations and to melt at moderately higher temperatures so as to be completely eliminated from the tubing, as further discussed below. If desired, the plug can be formed with a longer length within the tubing 110 to allow the plug to be used in high-pressure applications.

FIG. 1 is a diagrammatic cross-sectional view of an example well system 100 that includes an example apparatus 102 for removable plugging in a wellbore 104, according to an embodiment. The wellbore 104 is drilled in a ground 105 and is lined with a well casing 106. The wellbore 104 leads to a reservoir 108, such as an oil and/or natural gas reservoir.

The apparatus 102 includes a tubing 110 that has an exterior wall 112 and an interior wall 114. The tubing 110 is any suitable type of tubular element, such as a pup joint or a mandrel. In the example of FIG. 1, the apparatus 102 also includes a sleeve 116 having an exterior wall 118 and an interior wall 120. The sleeve 116 is configured to receive a heating element, such as a thermite element, in the manner further described below. The sleeve 116 includes a first notch 122 and a second notch 124 formed in the interior wall 120. The first and second notches 122 and 124 are usable to hold the thermite element in place, as also explained in detail below. A packer 126 is shown providing a seal between the inside of the well casing 106 and the exterior wall 112 of the tubing 110.

As shown in the example of FIG. 1, a metal alloy 128 is disposed in a space between the interior wall 114 of the tubing 110 and the exterior wall 118 of the sleeve 116. The metal alloy 128 is in a solid state and occupies the space between the interior wall 114 of the tubing 110 and the exterior wall 118 of the sleeve 116. In various embodiments, the metal alloy 128 is disposed in the space between the interior wall 114 of the tubing 110 and the exterior wall 118 of the sleeve 116 so as to form a gas-tight, metal-to-metal (MTM) seal according to techniques further described below. The metal alloy 128 thus defines a fluid barrier plug against flow of any portion of the reservoir 108 through the tubing 110.

While FIG. 1 shows the tubing 110 inserted into the wellbore 104, in various embodiments, the metal alloy 128 is disposed in the space between the interior wall 114 of the tubing 110 and the exterior wall 118 of the sleeve 116 so as to define the fluid barrier plug before the tubing 110 is inserted into the wellbore 104 as part of a completion in the well system 100. More particularly, in certain embodiments, the metal alloy 128 is disposed so as to define the removable fluid barrier plug while the tubing 110 is above the ground 105 and in a controlled manufacturing environment, allowing precise manufacturing of the gas-tight MTM seal. The fluid barrier plug is removable by melting as discussed in further detail below.

In some embodiments, the metal alloy 128 is a eutectic alloy. The eutectic alloy has a melting point that is selected in view of a temperature of the reservoir 108. For example, the eutectic alloy is selected to have constituents such that the melting point of the eutectic alloy is less than a threshold amount higher than the temperature of the reservoir 108, and, more particularly, higher than a maximum service temperature expected in the wellbore. This threshold amount can be, for example, 100 degrees Celsius higher than the temperature of the reservoir 108, or any other suitable amount higher than the temperature of the reservoir 108 or the maximum service temperature expected in the wellbore. Consequently, in various embodiments, the metal alloy 128 advantageously melts at a temperature moderately higher than the temperature of the reservoir 108 and is structurally sound at the moderately lower temperature of the reservoir 108. It will be appreciated in light of the present disclosure that, in various embodiments, the temperature of the reservoir 108 is approximately the temperature of the metal alloy 128 when the tubing 110 is disposed in the wellbore 104 and before the metal alloy 128 is melted.

In some embodiments, a ratio of constituents of the metal alloy 128 is varied in order to adjust the melting point in view of the temperature of the reservoir 108. For example, the metal alloy 128 can be a bismuth (Bi) and tin (Sn) eutectic alloy, and the Bi-to-Sn ratio can be varied in view of the temperature of the reservoir 108 so that the melting point of the metal alloy 128 is within the threshold amount of the temperature of the reservoir 128.

In some embodiments, the eutectic alloy selected to be the metal alloy 128 has constituents that are also or alternatively selected in view of one or more completion fluids to be used in completion operations of the well system 100. For example, the metal alloy can be selected to be a bismuth (Bi) and tin (Sn) alloy because a bismuth and tin alloy is highly corrosion resistant and thus is usable in completion environments that include brines, high strength acids, and other corrosive fluids.

Figure 2:
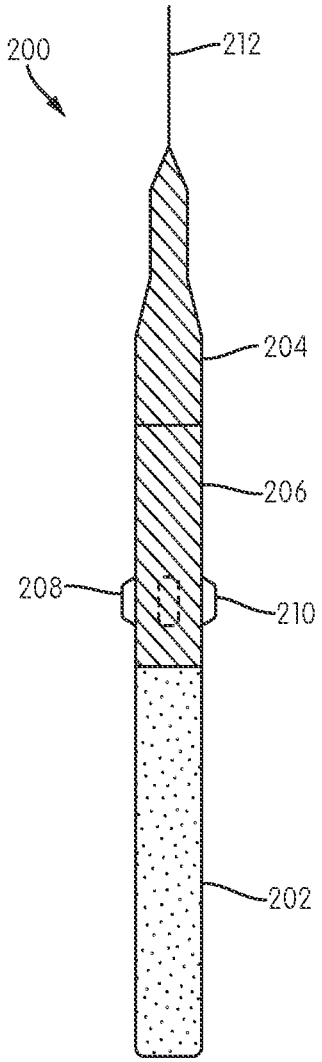
FIG. 2 is a cross-sectional view of an example heating apparatus that is usable to remove a fluid barrier plug defined by a metal alloy from a tubing, according to an embodiment.

FIG. 2 is a cross-sectional view of an example heating apparatus 200 that is usable to remove a fluid barrier plug defined by the metal alloy 128 from the tubing 110, according to an embodiment. The heating apparatus 200 includes a thermite element 202, such as a thermite heater or other suitable thermite device. In one embodiment, the heater is located within the sleeve. In certain embodiments, the heater is coupled to the sleeve so that, after the low melting point alloy plug has been melted, whatever conveyance method is used to position the heater permits both the heater and the sleeve to be recovered by returning those components to the surface, so as to leave full bore access for the completion. Other types of heating elements can be used in order to melt the metal alloy 128, such as heating elements using other fuel-oxidizer mixtures. The heating apparatus 200 also includes a firing head 204, a latching portion 206 having a first latch 208 and a second latch 210, and a cable 212 such as an electrical line or slickline.

The firing head 204 is coupled to the cable 212 and is coupled to the thermite element 202 via the latching portion 206. The firing head 204 is configured to ignite the thermite element 202 in response to a current flow through the cable 212 so as to cause the thermite element 202 to heat the metal alloy 128.

Figure 3:
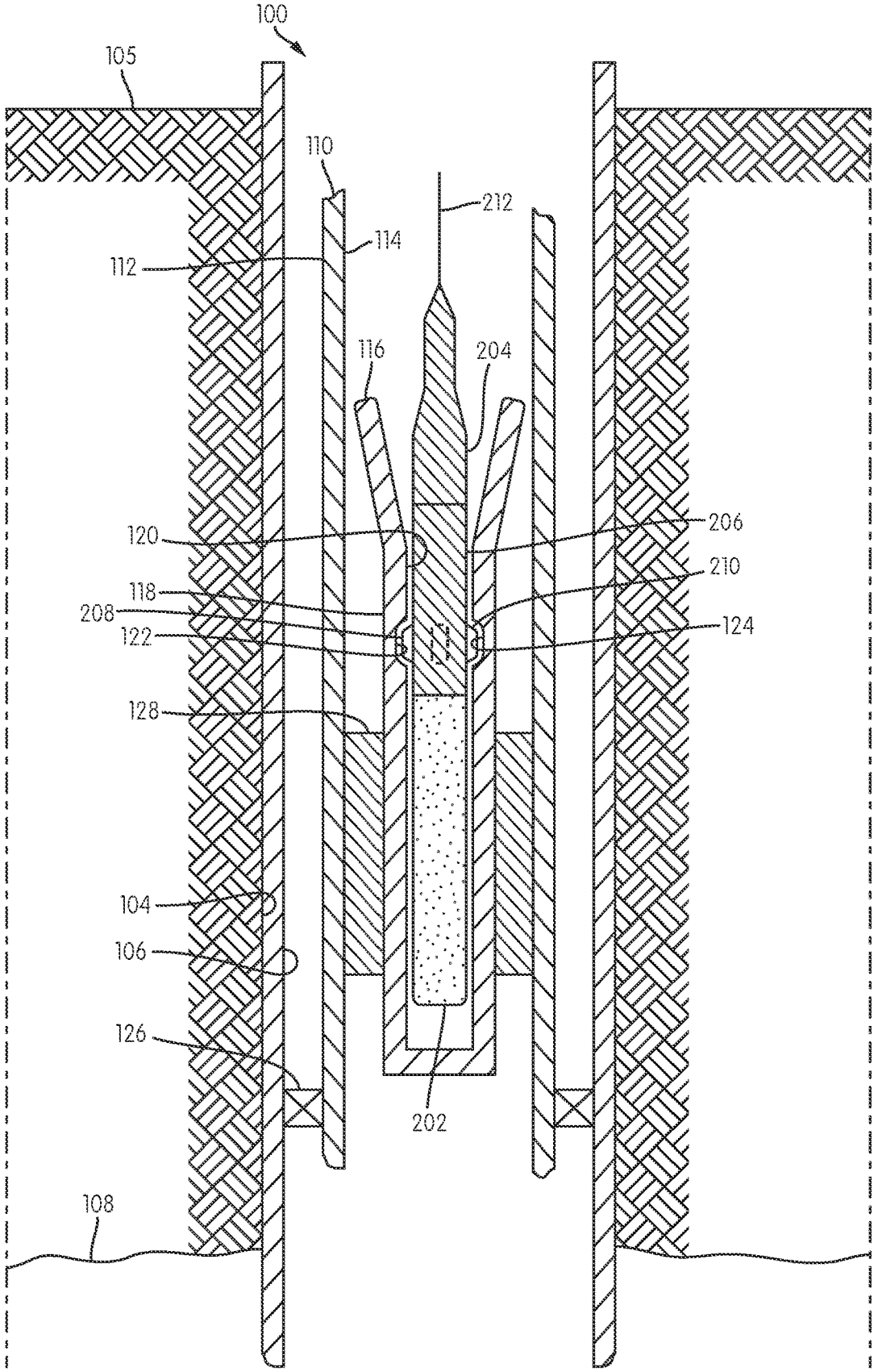
FIG. 3 is a diagrammatic cross-sectional view of the example well system showing the example heating apparatus of FIG. 2 inserted into the example apparatus of FIG. 1, according to an embodiment.

FIG. 3 is a diagrammatic cross-sectional view of the example well system 100 showing the example heating apparatus 200 of FIG. 2 inserted into the example apparatus 102 of FIG. 1, according to an embodiment. The combined apparatus of FIG. 3 is usable for removable plugging in the wellbore 104 by way of the thermite element 202 being used to melt the metal alloy 128 when the tubing 110 and the heating apparatus 200 are disposed in the wellbore 104. As shown in FIG. 3, the heating apparatus 200 is held in place within the sleeve 116 by the first latch 208 and the second latch 210 being moved into the first notch 122 and the second notch 124, respectively. In an embodiment, the first and second latches 208 and 210 are retractable, but the first and second latches 208 and 210 remain in the first and second notches 122 and 124, respectively, after the metal alloy 128 melts to allow the heating apparatus 200 and the sleeve 116 to be removed from the tubing 110 as a unit, as further described below. In some embodiments, the heating apparatus 200 is inserted into the sleeve 116 after formation of the fluid barrier plug when melting and removal of the plug is desired. In other embodiments, the heating apparatus 200 is pre-installed (e.g., pre-latched using the first and second latches 208 and 210) into the sleeve 116 before the tubing 110 is disposed in the wellbore 104 as part of a completion.

As illustrated in FIG. 3, the thermite element 202 is configured to selectively provide heat to the metal alloy 128 by way of the firing head 204 being configured to ignite the thermite element 202 while the thermite element 202 is held in the sleeve 116 using the first and second latches 208 and 210. In various embodiments, the thermite element 202 heats the metal alloy 128 to a temperature approximately 100 degrees Celsius above the melting point of the metal alloy 128, although other suitable temperatures are also envisioned. The metal alloy 128, such as a eutectic alloy as discussed above, melts into metal beads that fall by gravity into a sump of the well system 100. In an embodiment, the metal beads have a specific gravity of 10 such that they cannot be flowed out of the well system 100 and do not pose a debris risk for future through tubing operations. Selection of the melting point of the metal alloy 128 to be less than a threshold amount higher than the temperature of the reservoir 108, and heating of the metal alloy 128 to a suitable temperature in excess of the melting point, allows the metal alloy 128 to be eliminated from a cross-sectional area of the tubing 110 without damaging the interior wall 114 of the tubing 110, the exterior wall 118 of the sleeve 116, or any other completion components.

Figure 4:
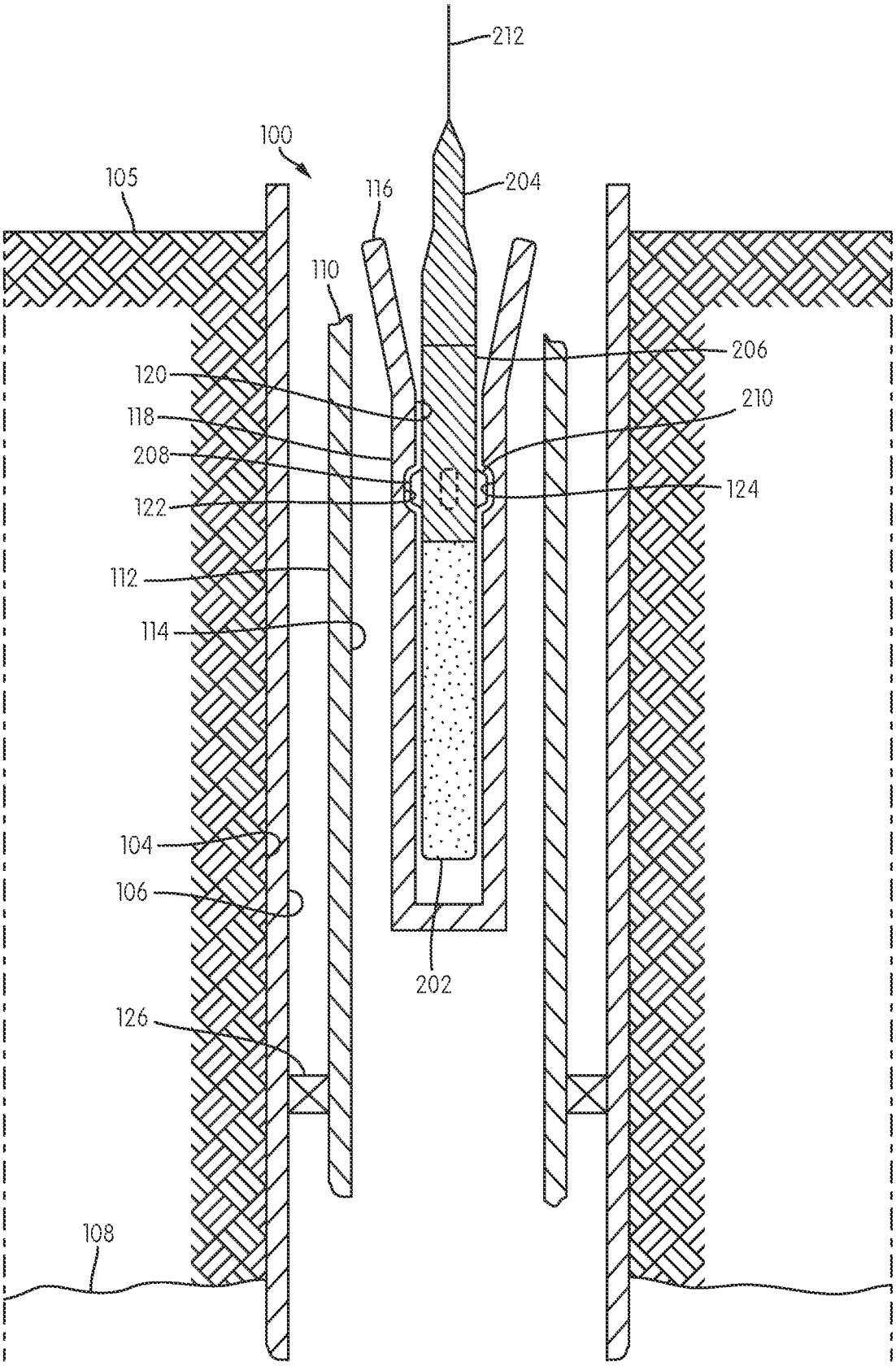
FIG. 4 is a diagrammatic cross-sectional view of the example well system after the metal alloy has been eliminated from the tubing, and during removal of a sleeve and components of the heating apparatus of FIG. 2 from the tubing, according to an embodiment.

FIG. 4 is a diagrammatic cross-sectional view of the example well system 100 after the metal alloy 128 has been eliminated from the tubing 110, and during removal of the sleeve 116 and the components of the heating apparatus 200 from the tubing 110, according to an embodiment. As shown in FIG. 4, the fluid barrier plug provided by the metal alloy 128 has been melted away, and the thermite element 202 is expended after igniting to heat the metal alloy 128. The thermite element 202 remains connected to the sleeve 116 by way of the first and second latches 208 and 210 remaining positioned in the first and second notches 122 and 124, respectively. The cable 212 is usable to pull the sleeve 116 and the thermite element 202 and other components of the heating apparatus 200 from the tubing 110 as a unit. FIG. 4 thus shows the sleeve 116, the thermite element 202, the firing head 204, and the latching portion 206 being pulled out of the wellbore 104 using the cable 212.

In other embodiments, any other suitable removal mechanism is attached to the firing head 204 instead of or in addition to the cable 212. For example, the cable 212 can be detached from the firing head 204 and replaced by an alternative wireline after the cable 212 delivers current to the firing head 204 to cause ignition of the thermite element 202. The cable 212 and/or alternative wireline can be attached to the firing head 204 using a fishing neck or any other suitable mechanism of attachment.

In other embodiments, the fluid barrier plug formed by the metal alloy 128 is not melted using the heating apparatus 200 and is instead removed by mechanical action such as drilling. For example, the fluid barrier plug can be drilled out to further reduce the risk of debris being left in the sump of the well system 100. The heating apparatus 200 is optional in these embodiments, and the sleeve 116 can be omitted or replaced by another suitable wall or structure that, with the interior wall 114 of the tubing 110, defines a fluid flow region within an interior of the tubing 110 and a space in which the metal alloy 128 is disposed to form the fluid barrier plug. In one embodiment where the fluid barrier plug formed by the metal alloy 128 is removed by drilling, the metal alloy 128 is a bismuth (Bi) and tin (Sn) alloy. A bismuth and tin alloy is of strength similar to aluminum, which is widely used in the oil industry for drillable completion products.

Figure 5:
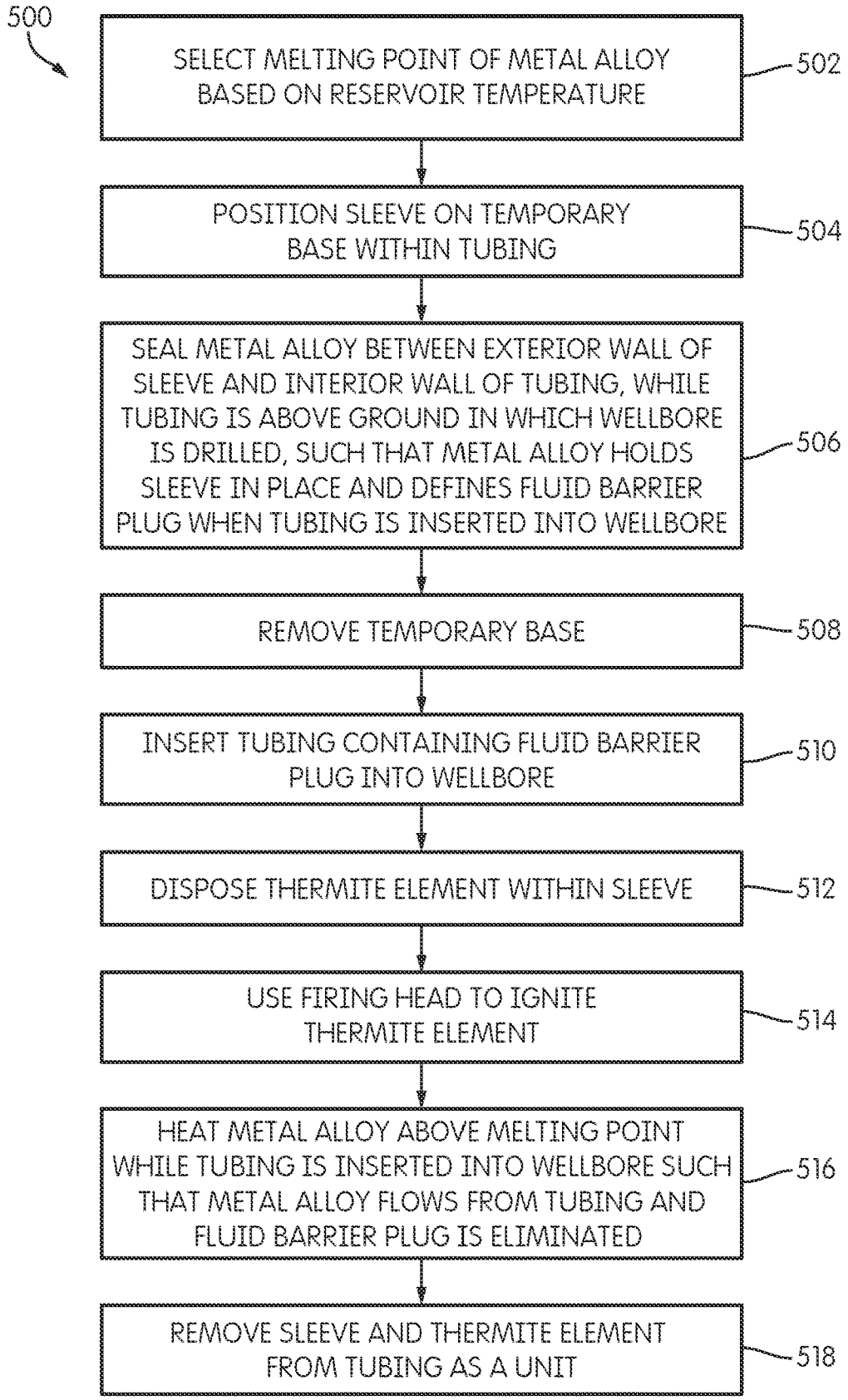
FIG. 5 is a flow chart of an example method for removable plugging in a wellbore, according to an embodiment.

FIG. 5 is a flow chart of an example method 500 for removable plugging in a wellbore, according to an embodiment. The method 500 and other methods disclosed herein can be implemented by and/or using components of the example apparatus 102 and/or the example heating apparatus 200 shown and described with respect to FIGS. 1, 2, 3, 4, and 6. It should be noted that in some embodiments, the order of the operations can be varied, and that some of the operations can be omitted.

The example method 500 begins with selecting 502 a melting point of a metal alloy based on a temperature of a reservoir to which the wellbore (e.g., the wellbore 104) leads. For example, the melting point of the metal alloy 128 is selected as described above, such as by selecting the metal alloy 128 to be a eutectic alloy, selecting a ratio of constituents of the metal alloy 128 such as a bismuth-to-tin ratio, and/or any other suitable techniques such as those described above.

The method 500 also includes positioning 504 a sleeve on a temporary base within a tubing. With reference to the example of FIG. 6, the sleeve 116 is shown positioned on a temporary base 602, according to an embodiment. The positioning 504 is performed before sealing the metal alloy 128 to define a fluid barrier plug and is performed before the tubing 110 is inserted into the wellbore 104.

Figure 6:
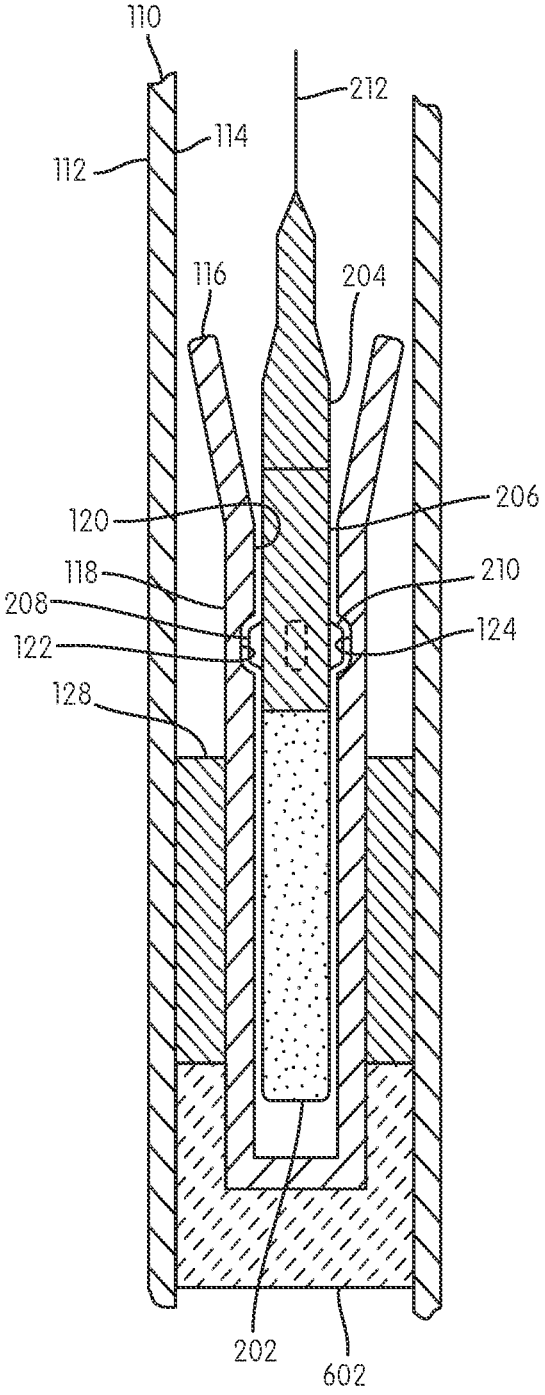
FIG. 6 is a diagrammatic cross-sectional view of a tubing showing a sleeve within the tubing positioned on a temporary base to facilitate sealing of a metal alloy to form a fluid barrier plug before insertion into a wellbore, according to an embodiment.

The method 500 also includes sealing 506 the metal alloy between an interior wall of the tubing and an exterior wall of the sleeve, while the tubing is above a ground in which the wellbore is drilled, such that the metal alloy holds the sleeve in place and defines a fluid barrier plug against flow of any portion of the reservoir through the tubing when the tubing is inserted into the wellbore. FIG. 6 shows the metal alloy 128 sealed between the interior wall 114 of the tubing 110 and the exterior wall 118 of the sleeve 116 while the tubing is outside of the well system 100, such that the metal alloy 128 will hold the sleeve 116 in place and define the fluid barrier plug once the tubing 110 is inserted into the wellbore 104, as shown in FIGS. 1 and 3. In various embodiments, as discussed above, the sealing 506 is performed in a controlled manufacturing environment.

The method 500 also includes removing 508 the temporary base after the sealing 506 of the metal alloy. The method 500 additionally includes inserting 510 the tubing containing the fluid barrier plug defined by the metal alloy into the wellbore, such as inserting the tubing 110 into the wellbore 104 as shown in FIG. 1. The fluid barrier plug defined by the metal alloy 128 is then used to facilitate completion operations such as pressure testing, as further described above.

The method 500 additionally includes disposing 512 a thermite element within the sleeve. For example, the thermite element 202 is disposed in the sleeve 116 by moving the first and second latches 208 and 210 of the latching portion 206 into the first and second notches 122 and 124. In various embodiments, a firing head, such as the firing head 204, is coupled to the thermite element 202 by way of the latching portion 206.

In some embodiments, the disposing 512 of the thermite element 202 within the sleeve 116 occurs before the inserting 510 of the tubing 110 into the wellbore 104. In some embodiments, the disposing 512 of the thermite element 202 within the sleeve 116 also occurs before the sealing 506 of the metal alloy 128 between the interior wall 114 of the tubing 110 and the exterior wall 118 of the sleeve 116. In these embodiments, the thermite element 202 is used to heat the space between the interior wall 114 of the tubing 110 and the exterior wall 118 of the sleeve 116 while the molten metal alloy 128 is poured on top of the temporary base 602. The sealing 506 is then accomplished when the metal alloy 128 cools and forms the fluid barrier plug in the space between the interior wall 114 of the tubing 110 and the exterior wall 118 of the sleeve 116. The thermite element 202 is then used again to heat the metal alloy 128 for plug removal as described elsewhere herein.

The method 500 also includes using 514 the firing head to ignite the thermite element. In some embodiments, a cable such as the cable 212 (e.g., an electrical line) is coupled to the firing head 204, and the firing head 204 ignites the thermite element 202 in response to a current flow through the cable 212.

The method 500 additionally includes heating 516 the metal alloy above the melting point while the tubing is inserted into the wellbore such that the metal alloy flows from the tubing and the fluid barrier plug is eliminated. For example, with reference to FIG. 3, the thermite element 202 is inserted into the sleeve 116 and is ignited using the firing head 204 to melt the metal alloy 128 and cause the metal alloy to completely from the space between the interior wall 114 of the tubing 110 and the exterior wall 118 of the sleeve 116.

More particularly, by using a metal alloy with a melting point within a threshold amount of a temperature of a reservoir to which the wellbore leads (e.g., the reservoir 108), and heating the metal alloy above the melting point by an amount such as 100 degrees Celsius above the melting point, the metal alloy is caused to completely flow from the space between the interior wall 114 of the tubing 110 and the exterior wall 118 of the sleeve 116 without reducing the inner diameter of the space. Additionally, by properly choosing the metal alloy and the melting point, including choosing a melting point within a threshold amount of a temperature of the reservoir, the metal alloy is caused to completely flow from the space between the interior wall 114 of the tubing 110 and the exterior wall 118 of the sleeve 116 without damaging the interior wall 114 of the tubing 110, the exterior wall of the sleeve 116, or any other completion components in the well system 100. In various embodiments, the metal alloy flows into a sump of the well system 100 and does not pose a debris risk, unlike known techniques using ceramic discs, slowly dissolving materials, and mechanical plugs.

The method 500 further includes removing 518 the sleeve and the thermite element from the tubing as a unit. For example, as shown in FIG. 4, the sleeve 116 and the thermite element 202 are removed from the tubing 110 as a unit using, in some embodiments, the cable 212 to pull the sleeve 116 and the thermite element 202 from the tubing 110 after the thermite element 202 is expended and the metal alloy 128 is melted.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to a technician or other user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A method for removable plugging in a wellbore which leads to a reservoir, the reservoir having a reservoir temperature, the method comprising:

selecting a melting point of a metal alloy based on the reservoir temperature;

sealing the metal alloy against an interior wall of a tubing while the tubing is above a ground outside of the wellbore, such that the metal alloy defines a fluid barrier plug against flow of fluid from the reservoir through the tubing when the tubing is disposed within the wellbore; and heating the metal alloy above the melting point while the tubing is disposed within the wellbore such that the metal alloy flows from the tubing and the fluid barrier plug is eliminated.

2. The method of claim 1, wherein sealing the metal alloy against the interior wall of the tubing comprises sealing the metal alloy between the interior wall of the tubing and an exterior wall of a sleeve disposed in the tubing, and wherein heating the metal alloy above the melting point comprises heating the metal alloy using a thermite element disposed within the sleeve.

3. The method of claim 2, further comprising using a firing head coupled to the thermite element to ignite the thermite element such that the thermite element heats the metal alloy above the melting point.

4. The method of claim 2, further comprising:

positioning the sleeve on a temporary base within the tubing before sealing the metal alloy; and removing the temporary base after sealing the metal alloy, wherein sealing the metal alloy comprises sealing the metal alloy between the exterior wall of the sleeve and the interior wall of the tubing such that the metal alloy holds the sleeve in place after the temporary base is removed.

5. The method of claim 2, further comprising removing the sleeve and the thermite element from the tubing as a unit after the fluid barrier plug is eliminated.

6. The method of claim 5, further comprising disposing the thermite element within the sleeve by moving at least one latch coupled to the thermite element into at least one corresponding notch of the sleeve, wherein removing the sleeve and the thermite element from the tubing as the unit comprises using a cable coupled to the thermite element to remove the sleeve and the thermite element from the tubing while the at least one latch is positioned in the at least one corresponding notch.

7. The method of claim 1, further comprising deploying a heater into the completion using a slickline, electric-line or coiled tubing.

8. The method of claim 1, wherein the heating step comprises causing a chemical reaction adjacent to the metal alloy to heat the metal alloy above the melting point while the tubing is disposed within the wellbore.

9. The method of claim 1, wherein selecting the melting point comprises selecting the melting point to be less than a threshold amount higher than the reservoir temperature, such that the heating of the metal alloy above the melting point causes the metal alloy to be eliminated from a cross-sectional area of the tubing without damaging the interior wall of the tubing.

10. The method of claim 1, wherein selecting the melting point comprises selecting a ratio of bismuth (Bi) to tin (Sn) in the metal alloy.

11. An apparatus for removable plugging in a wellbore which leads to a reservoir, the reservoir having a reservoir temperature, the apparatus comprising:

a tubing having an interior wall;

a sleeve having an exterior wall;

a metal alloy having a melting point selected in view of the reservoir temperature and being disposed in a space between the interior wall of the tubing and the exterior wall of the sleeve, wherein the metal alloy is in a solid state and occupies the space between the interior wall of the tubing and the exterior wall of the sleeve to thereby define a fluid barrier plug against flow of fluid from the reservoir through the tubing; and a thermite element configured to selectively provide heat to the metal alloy above the melting point when the tubing is inserted into the wellbore and thereby cause the metal alloy to flow from the space and eliminate the fluid barrier plug, wherein the sleeve and the thermite element are removable as a unit from the tubing when the fluid barrier plug is not present.

12. The apparatus of claim 11, wherein the metal alloy is a eutectic alloy selected in view of one or more completion fluids to be used in completion operations of a subterranean well defined by the wellbore.

13. The apparatus of claim 12, wherein the eutectic alloy is a bismuth (Bi) and tin (Sn) alloy.

14. The apparatus of claim 11, wherein the melting point is selected to be less than a threshold amount higher than the reservoir temperature such that the heat provided to the metal alloy above the melting point causes the metal alloy to be eliminated from a cross-sectional area of the tubing without damaging the interior wall of the tubing or the exterior wall of the sleeve.

15. The apparatus of claim 11, wherein the sleeve comprises at least one notch, and wherein the sleeve is configured to hold the thermite element when at least one corresponding latch coupled to the thermite element is moved into the at least one notch.

16. The apparatus of claim 11, further comprising a cable coupled to the thermite element, wherein the cable is usable to remove the sleeve and the thermite element from the tubing as the unit when the fluid barrier plug is not present.

17. The apparatus of claim 11, further comprising:

a cable; and a firing head coupled to the thermite element and to the cable, wherein the firing head is configured to ignite the thermite element in response to a current flow through the cable to cause the thermite element to provide the heat to the metal alloy.

18. An apparatus for removable plugging in a wellbore which leads to a reservoir, the reservoir having a reservoir temperature, the apparatus comprising:

a tubular item usable as part of a completion in a subterranean well defined by the wellbore, the tubular item having a first wall defining an interior of the tubular item;

a second wall within the interior of the tubular item, the first wall and the second wall defining a fluid flow region within the interior of the tubular item; and a metal alloy having a melting point selected in view of the reservoir temperature and being disposed in a space in the fluid flow region between the first wall and the second wall before the tubular item is disposed in the wellbore as part of the completion, wherein the metal alloy is in a solid state and occupies the space in the fluid flow region between the first wall and the second wall to thereby define a fluid barrier plug against flow of fluid from the reservoir through the tubular item when the tubular item is disposed in the wellbore as part of the completion, and wherein the metal alloy is configured to flow from the space upon being heated above the melting point such that the fluid barrier plug is eliminated.

19. The apparatus of claim 18, further comprising a thermite element configured to selectively provide heat to the metal alloy above the melting point when the tubular item is disposed in the wellbore as part of the completion and thereby cause the metal alloy to flow from the space such that the fluid barrier plug is eliminated, wherein the second wall separates the thermite element from the metal alloy.

20. The apparatus of claim 19, further comprising:

a cable; and a firing head coupled to the thermite element and to the cable, wherein the firing head is configured to ignite the thermite element in response to a current flow through the cable to cause the thermite element to provide the heat to the metal alloy.

21. The apparatus of claim 18, wherein the metal alloy is a eutectic alloy.

22. The apparatus of claim 21, wherein the eutectic alloy is a bismuth (Bi) and tin (Sn) alloy.

* * * * *